US007000805B1

(12) United States Patent
Wu et al.

(10) Patent No.: US 7,000,805 B1
(45) Date of Patent: Feb. 21, 2006

(54) PU FOAM RUBBER FLUID APPLICATOR

(76) Inventors: Chin-Ta Wu, No. 380, Baisha Road, Jiading Hsiang, Kaohsiung Hsien (TW); Tang-Yang Cheng, 9F-2, No. 600, Chunghua Road, Sec. 2, Taipei (TW)

( * ) Notice: Subject to any disclaimer, the term of this patent is extended or adjusted under 35 U.S.C. 154(b) by 269 days.

(21) Appl. No.: 10/702,164

(22) Filed: Nov. 4, 2003

(51) Int. Cl.
*B05B 5/03* (2006.01)

(52) U.S. Cl. ..... 222/323; 222/402.15; 222/474

(58) Field of Classification Search ..... 222/182, 222/323, 402.13, 402.15, 469, 470, 472, 222/473, 474
See application file for complete search history.

(56) References Cited

U.S. PATENT DOCUMENTS 2,820,578 A * 1/1958 Dickman ..... 222/323
3,506,159 A * 4/1970 Muller ..... 222/182
3,659,791 A * 5/1972 Clark ..... 222/474
3,734,357 A * 5/1973 Batistelli et al. ..... 222/323
4,089,440 A * 5/1978 Lee ..... 222/402.15
4,401,240 A * 8/1983 Brack ..... 222/323
4,579,258 A * 4/1986 Brown et al. ..... 222/323
4,971,257 A * 11/1990 Birge ..... 222/402.15
5,904,273 A * 5/1999 Aspacher et al. ..... 222/402.15
6,053,373 A * 4/2000 Sutton et al. ..... 222/402.13
6,173,870 B1 * 1/2001 Taylor ..... 222/402.15

* cited by examiner

*Primary Examiner*—Eric Keasel
(74) *Attorney, Agent, or Firm*—Pro-Techtor Int'l Services

(57) ABSTRACT

A PU foam rubber fluid applicator includes a handle, the handle having a receptacle adapted to accommodate a PU foam rubber can, a nozzle connected to the valve tube of the loaded PU foam rubber can, a lever pivoted to the receptacle and supported on a return spring and controlled by one finger of the user's hand holding the handle to lift the nozzle and to further open the valve tube of the PU foam rubber can, and a retaining block pivoted to the receptacle and forced by a spring member to lock the PU foam rubber can.

3 Claims, 10 Drawing Sheets

PU FOAM RUBBER FLUID APPLICATOR

BACKGROUND OF THE INVENTION

1. Field of the Invention

The present invention relates to a PU foam rubber fluid applicator for the application of a PU foam rubber fluid and, more particularly, to a laborsaving PU foam rubber fluid applicator.

2. Description of the Related Art

When applying PU foam rubber fluid from a PU foam rubber can to fill up the gaps between the door/window and the wall, gaps between the air conditioner and the wall, or the internal space of a door, plywood, or any of a variety of building materials, a PU foam rubber fluid applicator may be used. FIG. 1 shows a PU foam rubber fluid applicator according to the prior art. As illustrated, the PU foam rubber fluid applicator comprises a nozzle 200, the nozzle 200 having a top inner thread 201 for threading onto the outer thread 101 of the valve tube 102 of a PU foam rubber can 100, and two pressure members 202 provided at two sides of the nozzle 200. When in use, the loaded PU foam rubber can 100 is turned upside down, and then compress the pressure members 202 with both hands to force the valve tube 102, thereby causing the PU foam rubber fluid to flow out of the PU foam rubber can 100. This design of PU foam rubber fluid applicator is not satisfactory in function. Operating this structure of PU foam rubber fluid applicator requires much effort. When applying PU foam rubber fluid to a high place above the operator's head, the user may be unstable to compress the pressure members 202 stably and evenly.

SUMMARY OF THE INVENTION

The present invention has been accomplished under the circumstances in view.

It is the main object of the present invention to provide a PU foam rubber fluid applicator, which can conveniently be operated with one single hand to apply PU foam rubber fluid to any accessible places.

It is another object of the present invention to provide a PU foam rubber fluid applicator, which can easily be operated with less effort.

To achieve these and other objects of the present invention, the PU foam rubber fluid applicator is comprised of a handle, a retaining block, a nozzle, and a lever. The handle has one end terminating in a receptacle adapted to accommodate a PU foam rubber can. The nozzle is connected to the valve tube of the PU foam rubber can. The lever is pivoted to a bottom rod of the receptacle and supported on a return spring and controlled by one finger of the user's hand holding the handle to lift the nozzle and to further open the valve tube of the PU foam rubber can, and a retaining block pivoted to the receptacle and forced by a spring member to lock the PU foam rubber can.

DETAILED DESCRIPTION OF THE PREFERRED EMBODIMENT

Figure 1:
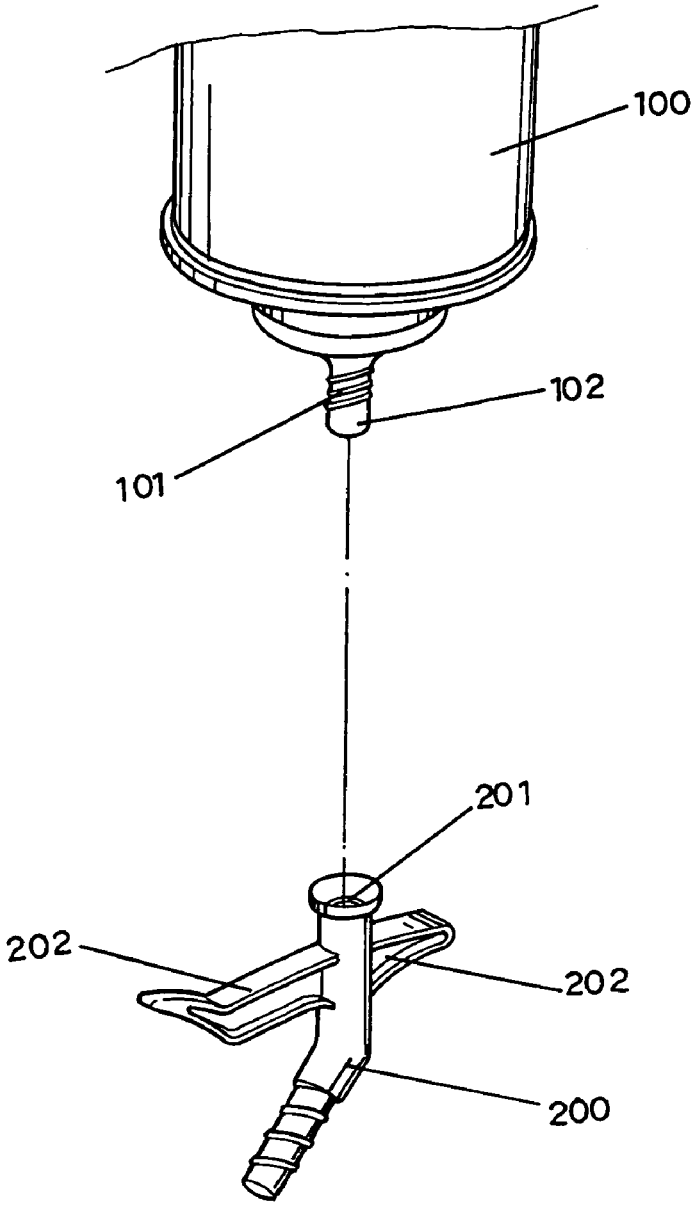
Fig.1 (Prior Art)
FIG. 1 is an exploded view of a PU foam rubber fluid applicator according to the prior art.
Figure 2:
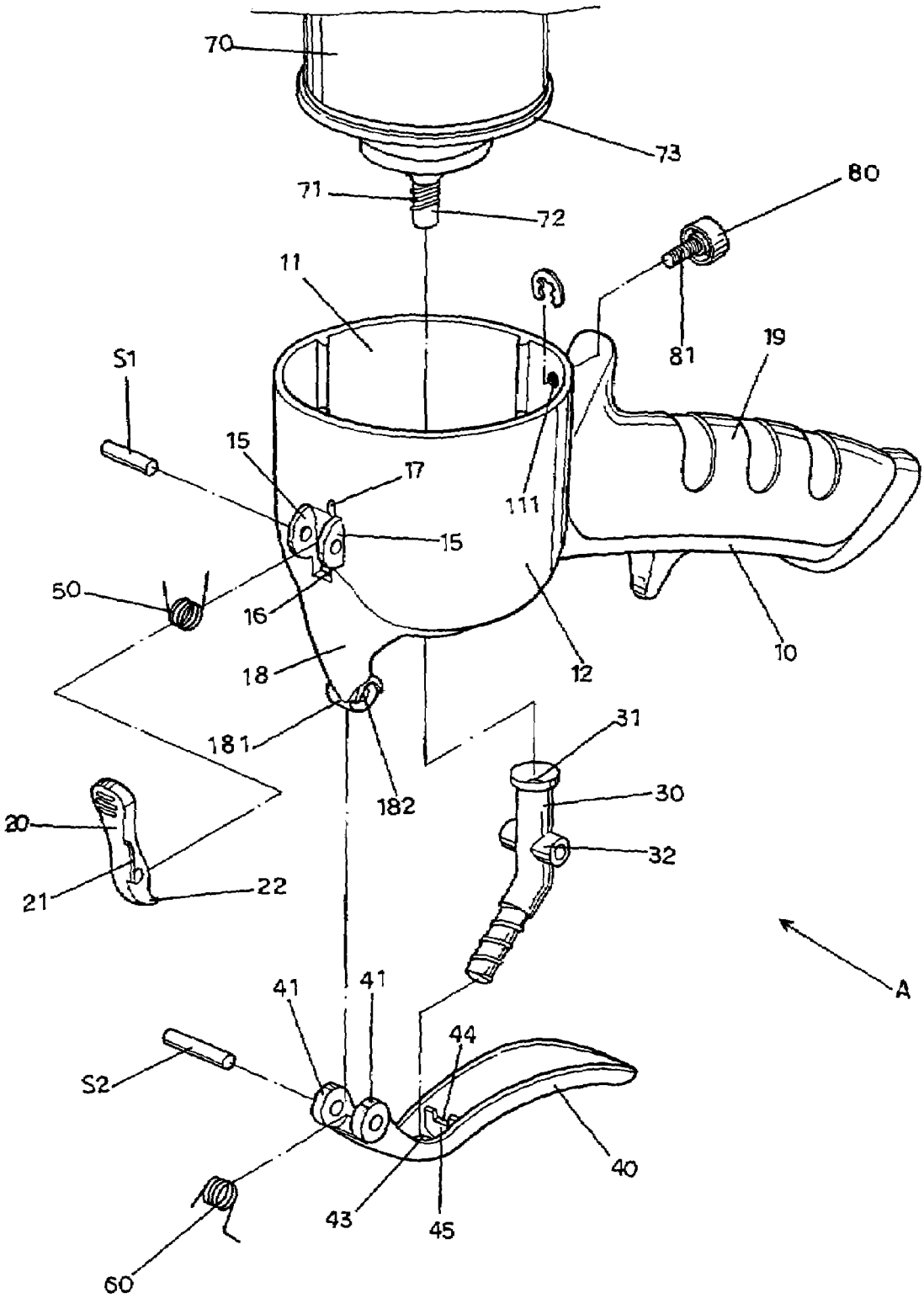
FIG. 2 is an exploded view of a PU foam rubber fluid applicator according to the present invention.
Figure 3:
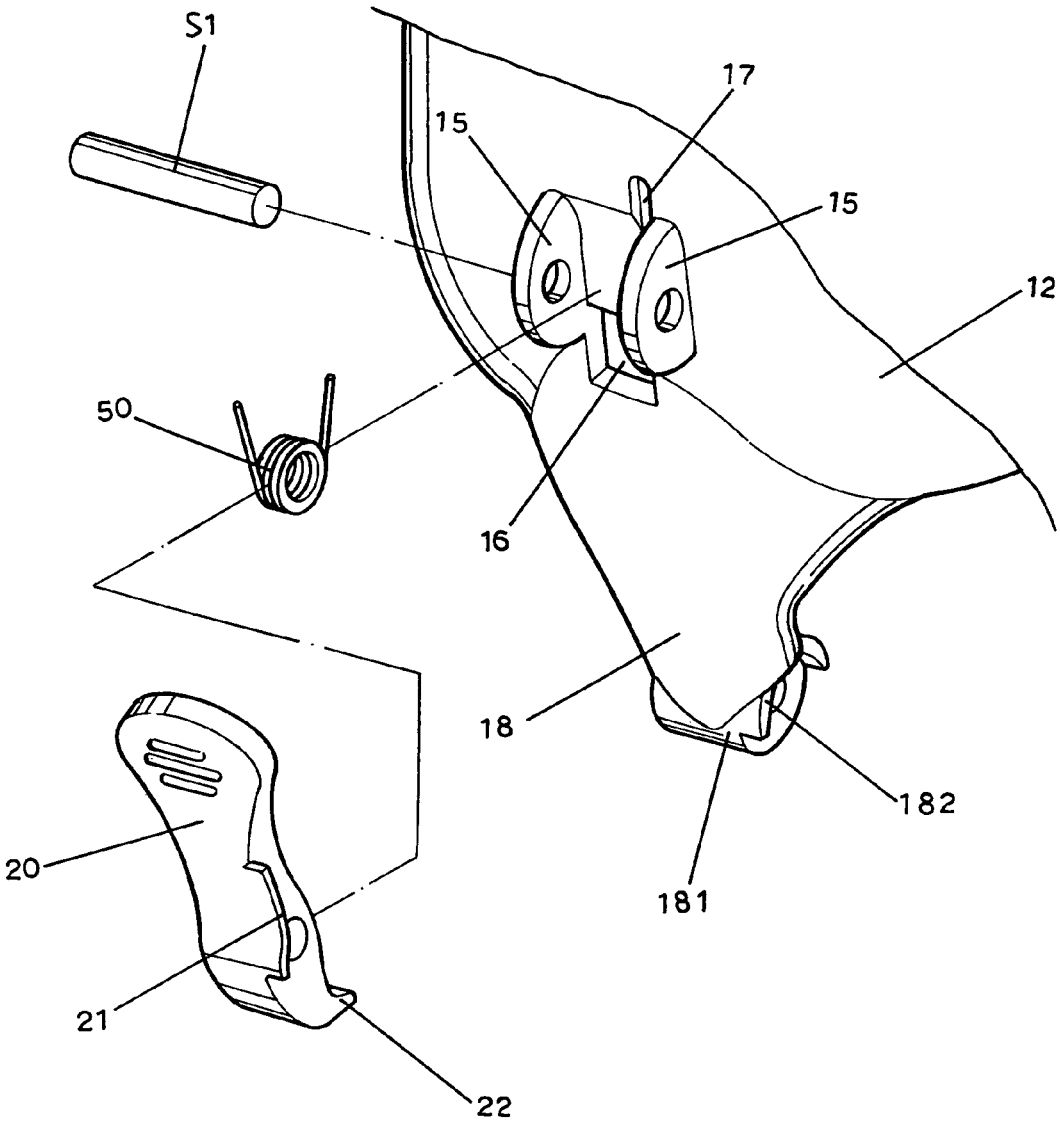
FIG. 3 is an exploded view in an enlarged scale of one part of the PU foam rubber fluid applicator according to the present invention.
Figure 4:
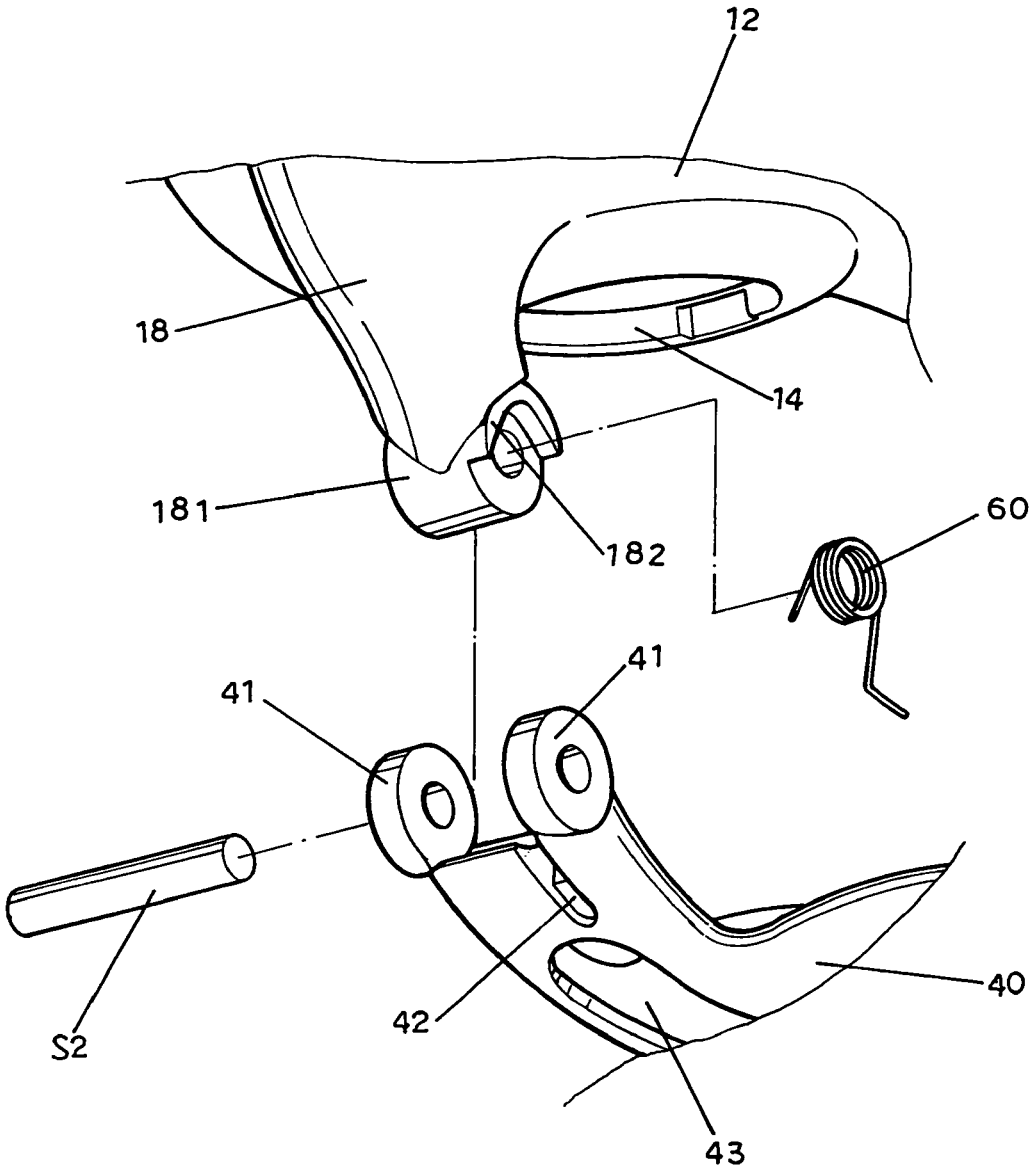
FIG. 4 is an exploded view in an enlarged scale of another part of the PU foam rubber fluid applicator according to the present invention.

Referring to FIGS. 2~4, a PU foam rubber fluid applicator A for PU foam rubber injector is shown comprised of a handle 10, a retaining block 20, a nozzle 30, a lever 40, a first torsional spring 50, and a second torsional spring 60.

Figure 5:
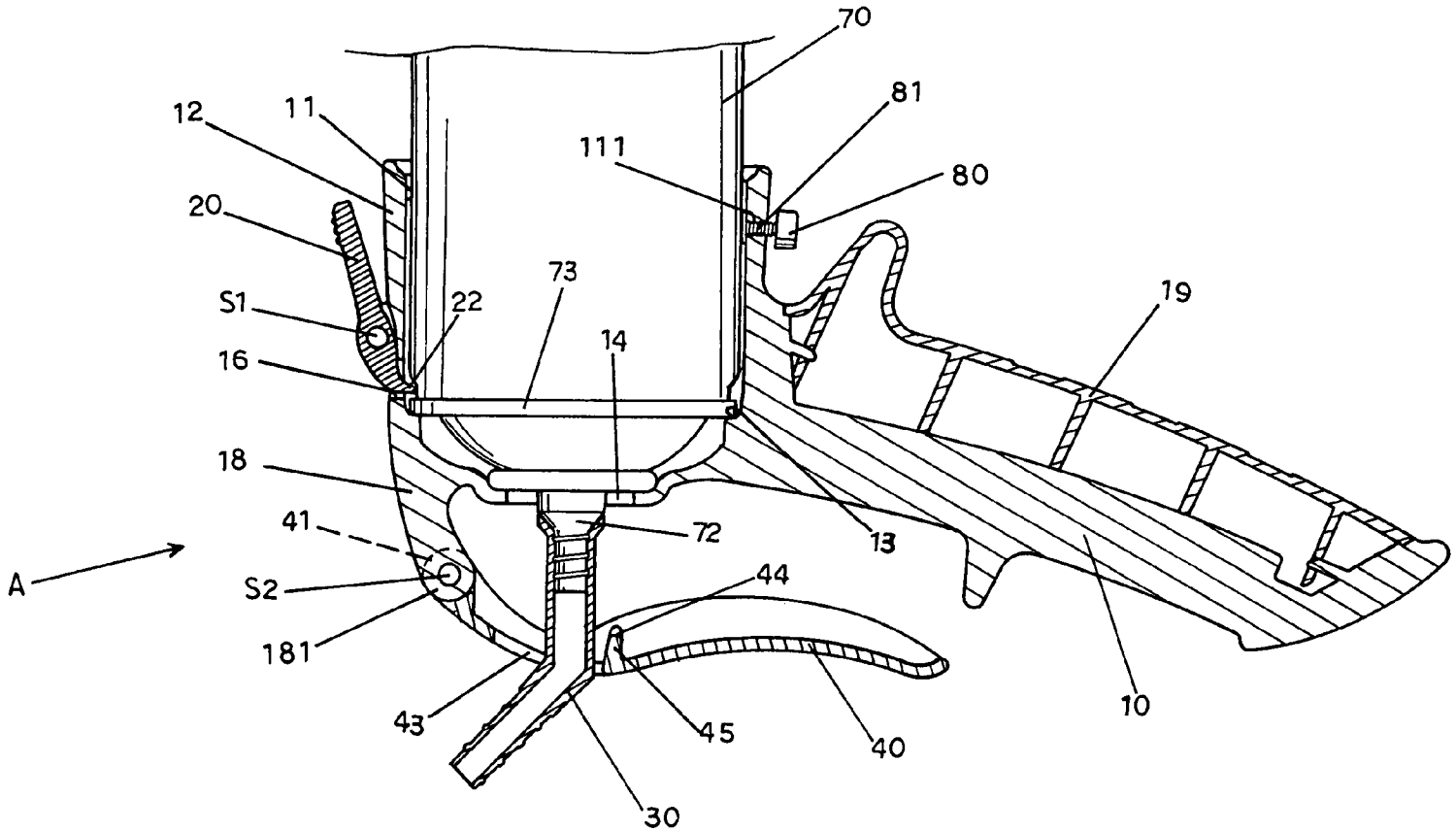
FIG. 5 is a sectional assembly view of the PU foam rubber fluid applicator according to the present invention.

The handle 10 has one end terminating in a receptacle 12. The receptacle 12 comprises a receiving open chamber 11, an inside annular flange 13 (see FIG. 5) disposed in the receiving open chamber 11, a bottom opening 14 at the center of the bottom side in fluid communication with the receiving open chamber 11 (see FIG. 4), a pair of parallel lugs 15 provided at the periphery, a through hole 16 through the peripheral between the lugs 15 in fluid communication with the receiving open chamber 11, a narrow groove 17 upwardly extended from the through hole 16, and a bottom rod 18 downwardly extended from the periphery at one side. The bottom rod 18 has a bottom end terminating in a transverse barrel 181 and a protruded portion 182 at one end of the transverse barrel 181.

The retaining block 20 has a stop flange 21 longitudinally disposed at one side, and a hooked portion 22 at one end.

The nozzle 30 has an inner thread 31 at the top end, and two push rods 32 aligned at two sides.

The lever 40 comprises two barrels 41 arranged in parallel at one end, a recessed portion 42 disposed in one end at the bottom side between the barrels 41 (see FIG. 4), a through hole 43 disposed adjacent to the recessed portion 42, and a locating block 45 transversely disposed at the top side on the middle. The locating block 45 has a top notch 44.

Figure 6:
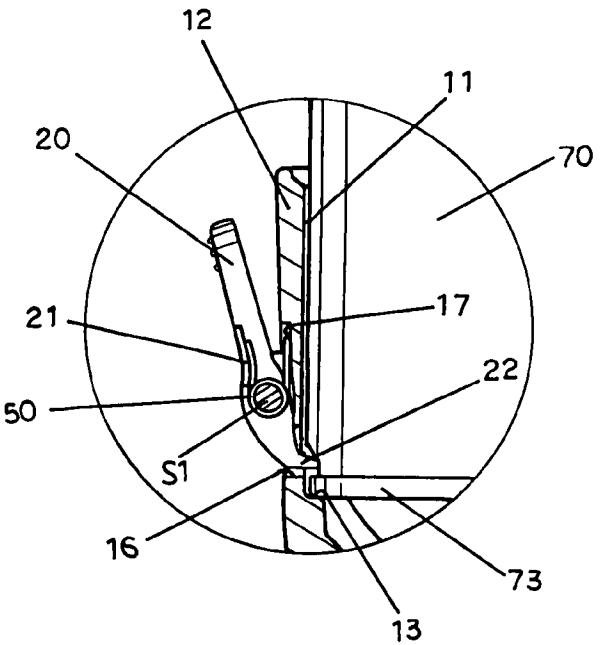
FIG. 6 is a sectional view in an enlarged scale of a part of the PU foam rubber fluid applicator according to the present invention (retaining block, receptacle, and PU foam rubber can).
Figure 7:
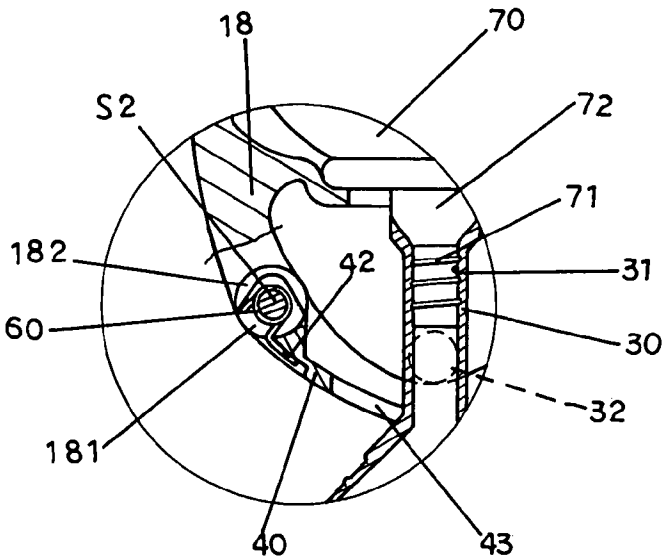
FIG. 7 is a sectional view in an enlarged scale of another part of the PU foam rubber fluid applicator according to the present invention (bottom rod of receptacle, lever, and nozzle).

The assembly process of the PU foam rubber fluid applicator A is outlined hereinafter. The PU foam rubber can 70 is set in the receiving open chamber 11 of the receptacle 12 to rest the flange 73 of the PU foam rubber can 70 on the inside annular flange 13 of the receptacle 12 (see FIG. 5), letting the valve tube 72 of the PU foam rubber can 70 extend out of the bottom opening 14 of the receptacle 12, and then the inner thread 31 of the nozzle 30 is threaded onto the outer thread 71 of the valve tube 72, and then the retaining block 20 and the first torsional spring 50 are put in between the lugs 15 and pivotally connected thereto with a first pivot S1, keeping the two opposite ends of the first torsional spring 50 respectively stopped at the stop flange 21 and the narrow groove 17 and letting the hooked portion 22 of the retaining block 20 pass through the through hole 16 and hook on the flange 73 of the PU foam rubber can 70 (see FIG. 6) to prevent falling of the PU foam rubber can 70 out of the receiving open chamber 11 of the receptacle 12, and then the through hole 43 of the lever 40 is coupled to the nozzle 30 for enabling the push rods 32 to be stopped at the top side of the lever 40, and then the second torsional spring 60 and the barrels 41 of the lever 40 are pivotally coupled to the barrel 181 of the bottom rod 18 of the receptacle 12 with a second pivot 52, keeping the two opposite ends of the second torsional spring 60 respectively stopped at the inner side of the protruded portion 182 and the recessed portion 42 of the lever 40 (see FIG. 7). When assembled, as shown in FIG. 8, the second torsional spring 60 imparts an upward pressure to the lever 40, thereby causing the lever to be stopped against the push rods 32.

Figure 11:
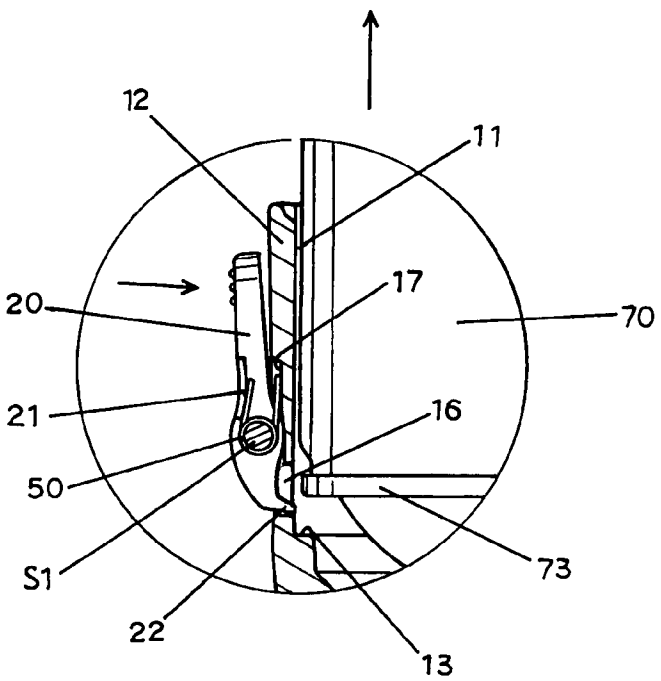
FIG. 11 is similar to FIG. 6 but showing the retaining block moved to the unlocking position.
Figure 10:
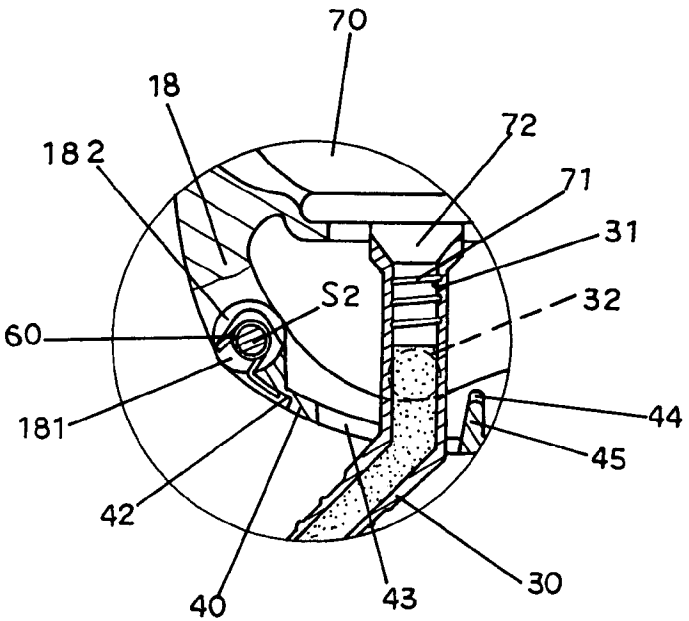
FIG. 10 is similar to FIG. 7 but showing the nozzle lifted, the valve tube of the PU foam rubber can opened.
Figure 8:
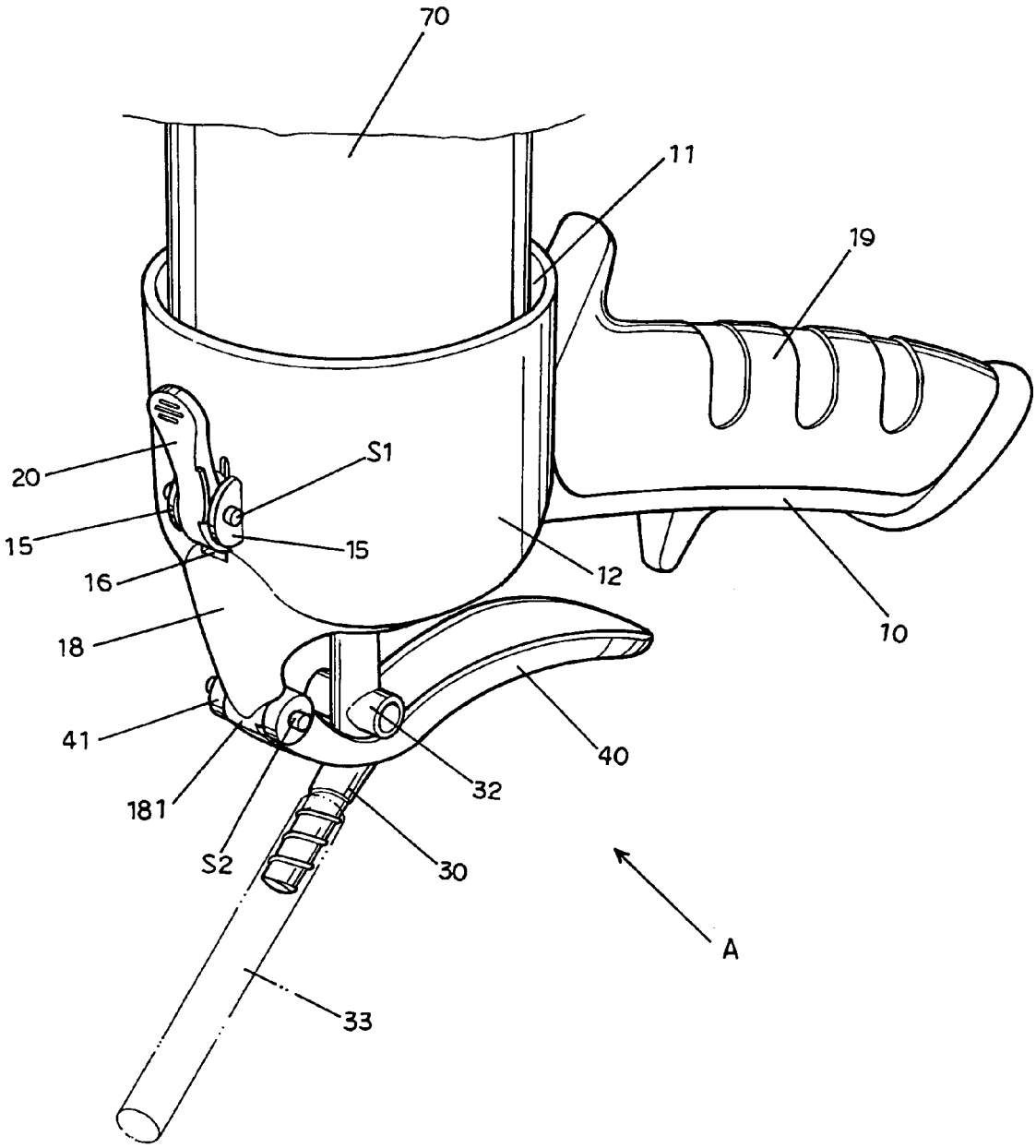
FIG. 8 is an elevational assembly view of the PU foam rubber fluid applicator according to the present invention (retaining block, receptacle, and PU foam rubber can).

When in use, attach a delivery tube 33 to the bottom end of the nozzle 30 (see FIG. 8), and then hold the handle 10 with the hand and pull the lever 40 with one finger (see FIG. 9) to push the push rods 32 upwards and to further force the nozzle 30 upwardly against the valve tube 72 of the PU foam rubber can 70 (see FIG. 10), thereby causing the valve tube 72 to be opened, for enabling the contained PU foam rubber fluid to pass out of the valve tube 72 to the delivery tube 33 via the nozzle 30 (see FIGS. 8 and 10). When released the hand from the lever 40, the second torsional spring 60 immediately returns the lever 40, and at the same time the valve tube 72 moves downwards from the open position to the close position by means of the spring power of its internal spring means (the structure of the valve tube 72 is of the known design and not within the scope of the claims of the present invention, no further detailed description in this regard is necessary). When the contained PU foam rubber fluid used up, press one end of the retaining block 20 to conquer the spring force of the first torsional spring 50, causing the retaining block 20 to turn about the first pivot S1 in one direction and to further disengage the hooked portion 22 from the flange 73 of the PU foam rubber cab 70 (see FIG. 11), and then rotate the PU foam rubber can 70 to disengage the outer thread 71 of the valve tube 72 from the inner thread 31 of the nozzle 30, for enabling the PU foam rubber can 70 to be taken out of the receiving open chamber 11 of the receptacle 12 for a replacement.

Figure 9:
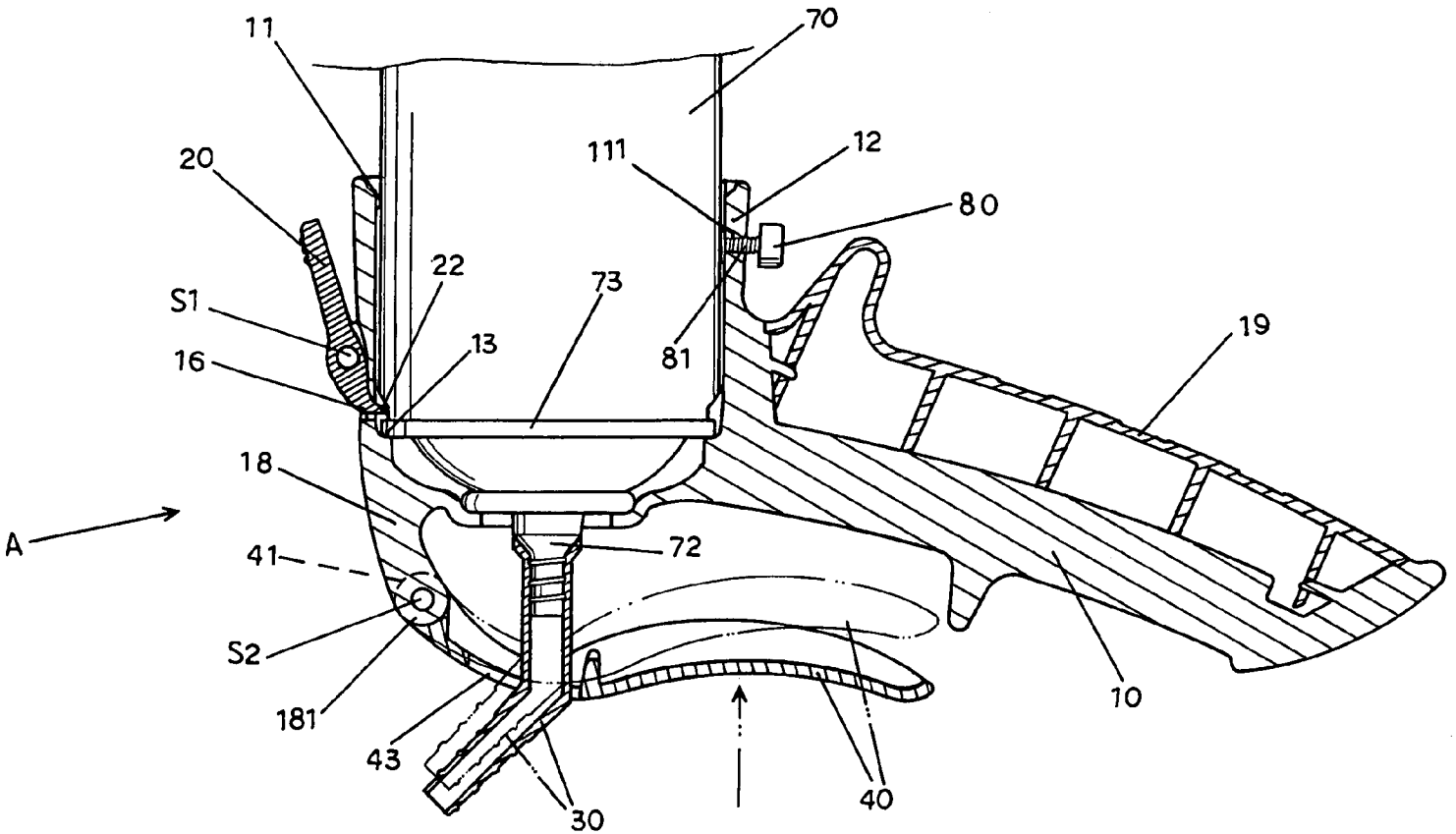
FIG. 9 is a schematic sectional view showing the operation of the PU foam rubber fluid applicator.
Figure 12:
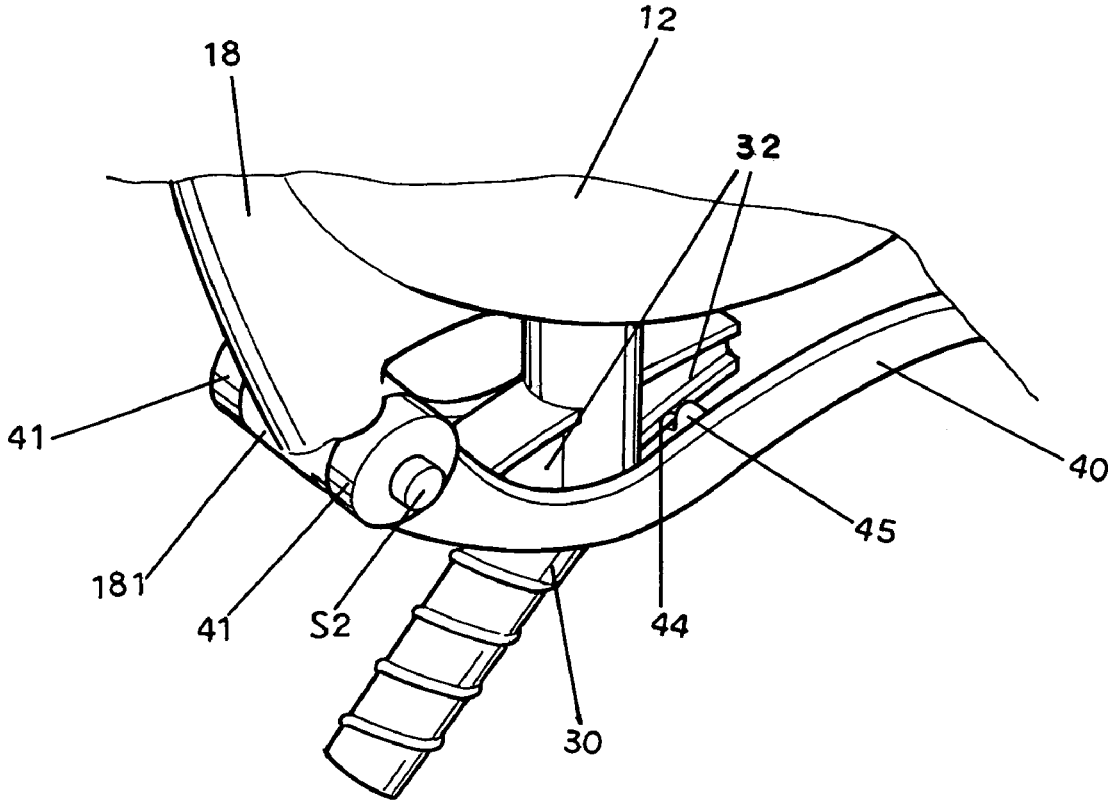
FIG. 12 is an elevational view of a part of an alternate form of the present invention.

Further, an anti-slip cap 19 may be capped on the top side of the handle 10 for positive gripping of the hand (see FIGS. 8 and 9). The nozzle 30 may be variously shaped. FIG. 12 shows the use of an alternate form of the nozzle 30. As illustrated in FIG. 12, the push rods 32 of the nozzle 30 are respectively stopped at the notch 44 of the locating block 45 and an inside wall of the lever 40. This alternate form achieves the same effect.

The receptacle 12 further comprises a screw hole 111 disposed in communication with the receiving open chamber 11 (see FIG. 2) for receiving a tightening up screw 80. The threaded shank 81 of the tightening up screw 80 is threaded into the screw hole 111 and stopped against the periphery of the PU foam rubber can 70 to hold the PU foam rubber can 70 in position (see FIGS. 5 and 9). A C-shaped retainer may be fastened to the threaded shank 81 of the tightening up screw 80, preventing the tightening up screw 80 from falling out of the receptacle 12. When wishing to replace the PU foam rubber can 70, the tightening up screw 80 must be loosened.

As indicated above, after loading of a PU foam rubber can 70, the user can conveniently apply the contained PU foam rubber fluid to fill up gaps between the door/window and the wall, gaps between the air conditioner and the wall, or the internal space of a door, plywood, or any of a variety of building materials. When applying the contained PU foam rubber fluid, the user needs only to hold the handle 10 with the hand and then to pull the lever 40 with one finger to further lift the nozzle 30 and the valve tube 72 of the PU foam rubber can 70.

Although particular embodiments of the invention have been described in detail for purposes of illustration, various modifications and enhancements may be made without departing from the spirit and scope of the invention.

What is claimed is:

1. A PU foam rubber fluid applicator adapted to hold a PU foam rubber can and to control output of a PU foam rubber fluid from the valve tube of the loaded PU foam rubber can, the PU foam rubber fluid applicator comprising:

a handle, said handle comprising a receptacle at one end thereof, said receptacle comprising a receiving open chamber adapted to receive a PU foam rubber can, an inside annular flange disposed in said receiving open chamber, a bottom opening at the center of a bottom side thereof in fluid communication with said receiving open chamber, a pair of parallel lugs provided at the periphery thereof, a through hole through the peripheral between said lugs in fluid communication with said receiving open chamber, a narrow groove upwardly extended from said through hole, and a bottom rod downwardly extended from the periphery at one side, said bottom rod having a bottom end terminating in a transverse barrel and a protruded portion at one end of said transverse barrel;

a first pivot fastened to said lugs of said receptacle;

a retaining block pivotally connected to said first pivot, said retaining block having a stop flange longitudinally disposed at one side, and a bottom end terminating in a hooked portion adapted to hook on a part of the PU foam rubber can set in said receiving open chamber;

a first torsional spring mounted on said first pivot, said first torsional spring having two ends respectively fastened to the narrow groove of said receptacle and the stop flange of said retaining block;

a nozzle adapted to receive the valve tube of the PU foam rubber can set in said receiving open chamber, said nozzle having an inner thread at a top end thereof for fastening to the valve tube of the PU foam rubber can set in said receiving open chamber, and two push rods aligned at two sides;

a second pivot fastened to the barrel of the bottom rod of said receptacle;

a lever adapted to lift said nozzle and to further open the valve tube of the PU foam rubber can set in said receiving open chamber, said lever comprising two barrels arranged in parallel at one end and respectively pivotally coupled to said second pivot at two sides of the barrel of said receptacle, and a recessed portion disposed in one end, a through hole disposed adjacent to said recessed portion for the passing of said nozzle; and a second torsional spring mounted on said second pivot, said second torsional spring having two opposite ends respectively fastened to the inner side of the protruded portion of the bottom rod of said receptacle and the recessed portion of said lever.

2. The PU foam rubber fluid applicator as claimed in claim 1, wherein said lever further comprises a locating block transversely disposed at a top side thereof, said locating block having a top notch adapted to support one push rod of said nozzle.

3. The PU foam rubber fluid applicator as claimed in claim 1, wherein said receptacle further comprises a screw hole disposed in communication with said receiving open chamber, and a tightening up screw threaded into said screw hole and adapted to hold down a PU foam rubber can in said receiving open chamber.

* * * * *